US005119853A

United States Patent [19]

Petri et al.

[11] Patent Number: 5,119,853

[45] Date of Patent: Jun. 9, 1992

[54] APPARATUS FOR FILLING CANS WITH A LIQUID

[75] Inventors: Ulrich H. Petri, Elm Grove, Wis.; Friedrich Rademacher, Kamen. Südkamen; Siegmar Sindermann, Kamen-Heeren, both of Fed. Rep. of Germany

[73] Assignee: H&K Inc., Waukesha, Wis.

[21] Appl. No.: 527,950

[22] Filed: May 24, 1990

Related U.S. Application Data

[62] Division of Ser. No. 229,815, Aug. 8, 1988, Pat. No. 4,938,261.

[51] Int. Cl.[5] ..... B67C 3/06; B67C 3/12

[52] U.S. Cl. ..... 141/39; 141/40; 141/6

[58] Field of Search ..... 141/6, 39, 40, 41, 46–48, 141/144–147, 230, 290, 301, 302, 305, 308

[56] References Cited

U.S. PATENT DOCUMENTS

| | | | |
|---|---|---|---|
| 2,063,326 | 12/1936 | Meyer . | |
| 2,174,384 | 9/1939 | Fouser . | |
| 2,597,943 | 5/1952 | Meyer . | |
| 3,143,151 | 8/1964 | Denis . | |
| 4,086,943 | 5/1978 | Fernandez | 141/39 |
| 4,089,353 | 5/1978 | Antonelli | 141/302 |
| 4,109,446 | 8/1978 | Krohn | 53/282 |
| 4,349,055 | 9/1982 | DiChiara | 141/39 |
| 4,369,820 | 1/1983 | Ahlers et al. | 141/39 |
| 4,381,808 | 5/1983 | Ahlers | 141/39 |
| 4,589,453 | 5/1986 | Weiss | 141/39 |
| 4,644,981 | 2/1987 | Bernhard | 141/39 |
| 4,688,608 | 8/1987 | Puskarz | 141/39 |
| 4,750,5[illegible] | 6/1988 | Yun | 141/46 |
| 4,798,234 | 1/1989 | Dugan | 141/165 |
| 4,938,261 | 7/1990 | Petri et al. | 141/39 |
| 4,949,764 | 8/1990 | Clusserath | 141/6 |
| 4,989,650 | 2/1991 | Weiss | 141/6 |
| 5,000,234 | 3/1991 | Weiss | 141/6 |
| 5,040,574 | 8/1991 | Petri et al. | 141/39 |
| 5,065,799 | 11/1991 | Weiss | 141/39 |

FOREIGN PATENT DOCUMENTS 1129851 5/1962 Fed. Rep. of Germany .

*Primary Examiner*—Ernest G. Cusick

*Attorney, Agent, or Firm*—Andrus, Sceales, Starke & Sawall

[57] ABSTRACT

An apparatus for filling cans with a liquid such as beer or soft drinks. The filling machine includes a turntable having a surface to support a plurality of open top cans and a reservoir containing a liquid is spaced above the supporting surface. A plurality of filling heads are mounted on the reservoir and serve to dispense the liquid into the individual cans. Each filling head includes a spring loaded cylindrical tulip adapted to seal against the upper edge of the can and a vent tube and fill tube are disposed concentrically within the tulip. The lower end of the vent tube communicates with the can while the upper end is sealed against the surface of the reservoir and when the sealing engagement is released the vent tube communicates with the headspace of the reservoir. The lower end of the fill tube carries a valve that controls flow of liquid from the reservoir into the can. After the tulip seals against the can, pure carbon dioxide is introduced into the can from a separate reservoir and air is vented from the can to the atmosphere. A differential in force acting against opposite ends of the vent tube will act to lower the vent tube into the can and the valve is opened to admit liquid to the can with the gas from the can being discharged through the vent tube to the reservoir headspace. When the liquid rises in the can to the level of the vent tube, the liquid will move partially up within the vent tube. The vent tube is elevated to compress the gas therein and force the liquid out of the vent tube. The gas is then released from the head space of the can to the atmosphere.

5 Claims, 6 Drawing Sheets

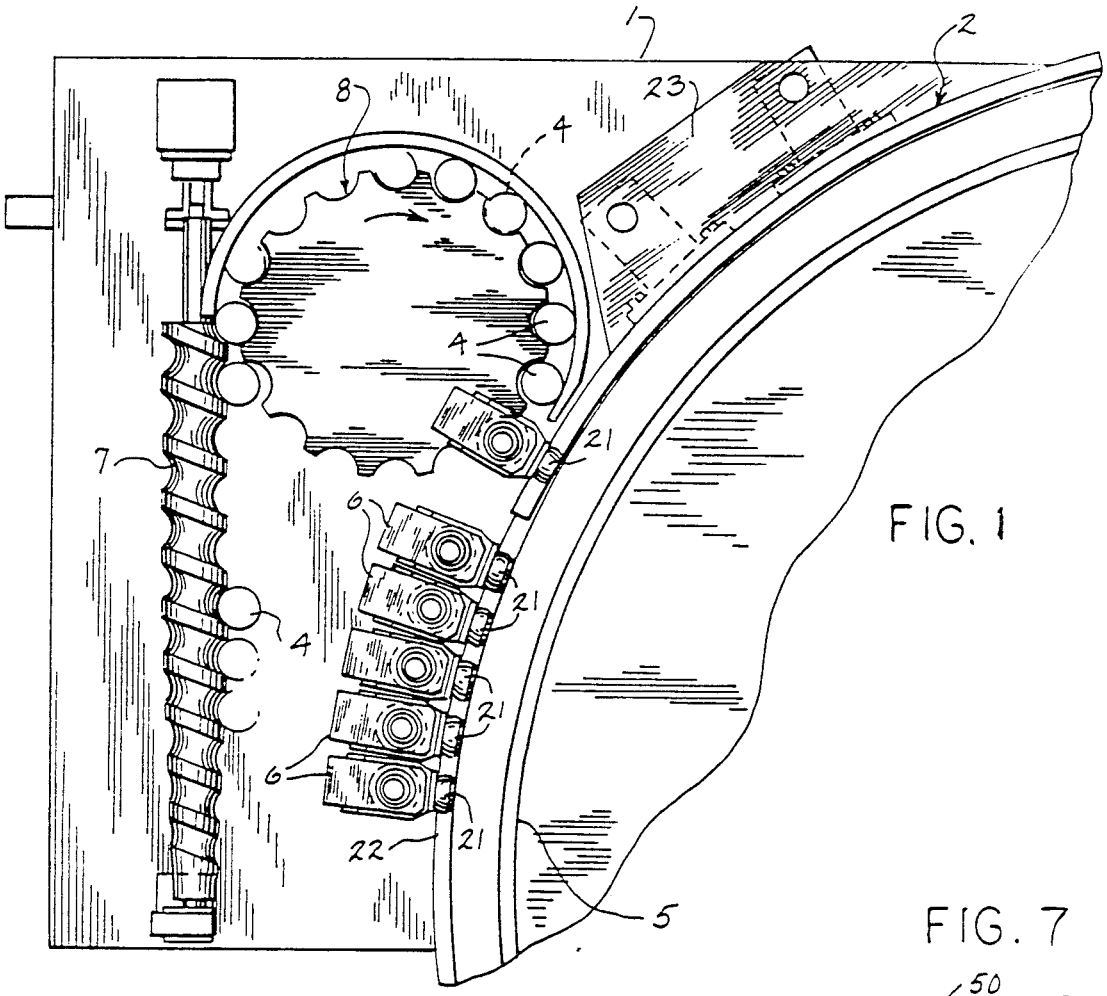
FIG. 1
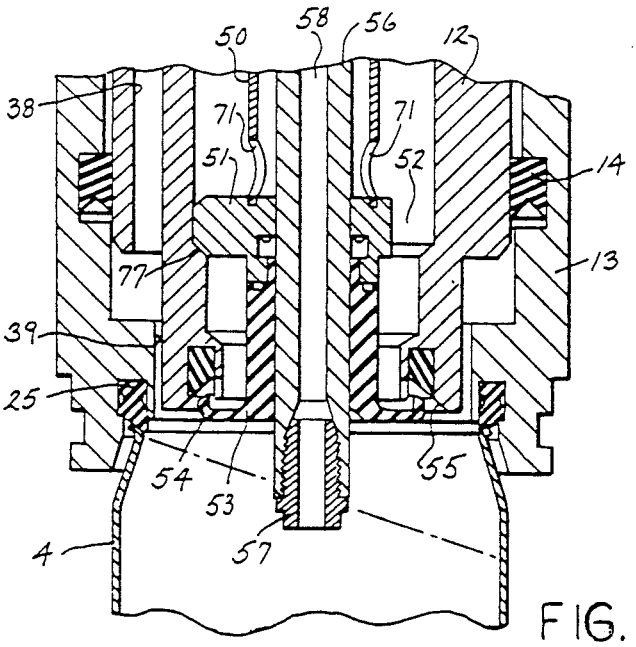
FIG. 6
FIG. 7
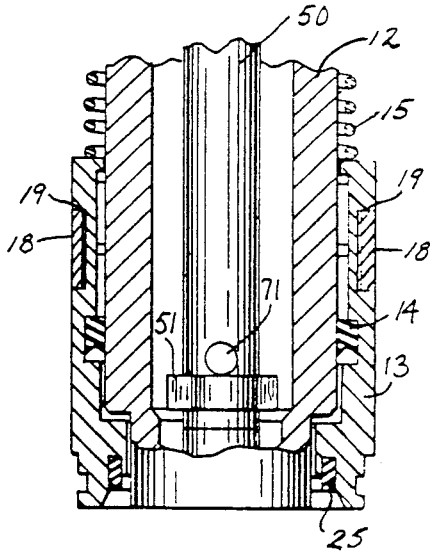

APPARATUS FOR FILLING CANS WITH A LIQUID

This is a division of application Ser. No. 07/229,815, filed Aug. 8, 1988, now U.S. Pat. No. 4,938,261.

BACKGROUND OF THE INVENTION

In a conventional filling machine for filling a can with a beverage, such as beer or soft drinks, the cans are fed by a star wheel conveyor to the filling machine and individually positioned on a surface of a rotating turntable beneath a filling head. With the can positioned on the surface, a cylindrical tulip is moved downwardly and seals against the upper edge of the can.

The conventional filling machine also includes a bowl or reservoir which is spaced above the supporting surface and contains the liquid or beverage while the headspace above the liquid contains carbon dioxide.

In the typical filling operation, the can which is sealed against the tulip is initially purged with carbon dioxide from the bowl for a predetermined time period to flush air from the can. A vent tube and a filler tube are mounted concentrically within the tulip, and after purging with carbon dioxide, liquid is introduced from the bowl into the can while the gas from the can is vented into the headspace of the bowl through the vent tube. The liquid will rise in the vent tube to the liquid level of the bowl, and in the conventional filling machine the liquid is blown from the vent tube using gas from the filler bowl headspace. The gas is then released from the headspace of the can to the atmosphere by an operation commonly referred to as "snifing".

The conventional filling machine has certain drawbacks. The carbon dioxide which is used to purge the cans is not pure carbon dioxide but is contaminated with air or oxygen due to the fact that the gas vented to the headspace of the bowl contains some air and the headspace gas is then used for purging during the next cycle. The oxygen contaminant in the carbon dioxide can could cause flavor deterioration of the liquid or beverage being canned.

A further disadvantage of the conventional filling process is that the liquid drawn upwardly within the vent tube is removed by blowing gas from the filling bowl through the vent tube into the can, or alternately, blowing out the vent tube after the can has been removed from the filling head. In the former situation, the blowing of the vent tube with the headspace gas from the bowl can cause foaming of the product as well as incorporation of gas within the product, while blowing the vent tube after the can has been removed from the filling head results in product loss.

In the conventional filling machine, the vent tube is fixed to the tulip with the result that the tulip, by necessity, has a relatively long stroke of movement which adversely affects the overall speed of the filling operation.

As the gas in the filling bowl is used to pressurize the can in the conventional machine, the liquid level in the bowl is critical and determines the fill height of liquid within the can.

With the conventional filling machine there is a slight amount of residual liquid remaining between the valve or screen and the lower end of the filling nozzle which is commonly referred to as "after run". While the "after run" is normally within fill tolerances, the liquid level cannot be precisely controlled due to the "after run".

SUMMARY OF THE INVENTION

The invention is directed to an improved filling machine for filling cans with a liquid or beverage. In accordance with the invention, the filling machine includes a turntable having a supporting surface to support a plurality of open top cans. A bowl or reservoir containing liquid is spaced above the supporting surface and a plurality of filling heads communicate with the bowl and serve to dispense the liquid into the individual cans.

Each filling head includes a spring loaded, cylindrical tulip which is adapted to be lowered to seal against the upper edge of the can, and a vent tube and fill tube are mounted concentrically within the tulip.

The vent tube is movably mounted with respect to the tulip and the upper end of the vent tube is adapted to seal against the top surface of the bowl, and when the sealing engagement is released, the vent tube communicates with the headspace of the bowl.

The lower end of the fill tube defines a seat and an annular siphon valve is engaged with the seat to control the flow of liquid from the bowl to the can.

After the tulip is sealed against the upper edge of the can, pure carbon dioxide from a separate reservoir is purged into the can and air from the can is simultaneously vented to the atmosphere. After the purging, a differential in force applied to opposite ends of the vent tube acts to lower the vent tube into the can, and the fill tube is then lowered to open the siphon valve and also release the seal between the upper end of the vent tube and the bowl so that liquid is introduced from the bowl into the can while gas in the can is discharged through the open upper end of the vent tube to the headspace of the bowl.

During the filling cycle, liquid will rise in the can until the liquid level covers the lower end of the vent tube and the liquid will then rise in the vent tube to approximately the level of liquid in the bowl. To release the liquid from the vent tube, the vent tube is lifted relative to the tulip to compress the gas in the upper end of the vent tube and force the liquid out of the vent tube and into the can. The gas is then released from the headspace of the can to complete the filling operation.

With the invention, pure carbon dioxide is employed to purge the can, as opposed to prior filling operations in which contaminated carbon dioxide from the headspace of the bowl has been used. By using pure carbon dioxide, the product will be free of oxygen to thereby prevent any possible deterioration of the product.

In the invention, the liquid within the vent tube is discharged by elevating the vent tube to cause the gas in the upper end of the vent tube to be compressed. This manner of emptying the vent tube of liquid minimizes foaming of the product as well as preventing loss of product as can occur in conventional systems where the vent tube is purged of liquid after the can is removed from the filling head.

With the construction of the invention, an annular siphon valve is employed to control the flow of liquid into the can and this provides a laminar-type of flow into the can which minimizes turbulence and possible foaming. The siphon valve also prevents "after run" of liquid into the can.

As the vent tube is not fixed to the tulip and can move independently, the stroke of the tulip is reduced, thereby enabling the speed of operation to be increased.

Since the gas in the headspace of the bowl is not utilized to pressurize the can, the liquid level in the bowl is not critical to the operation.

Other objects and advantages will appear in the course of the following description.

DESCRIPTION OF THE DRAWINGS

The drawings illustrate the best mode presently contemplated of carrying out the invention.

In the drawings:

FIG. 1 is a fragmentary plan view of the turntable of the filling machine and the in-feed conveyor;

FIG. 6 is an enlarged fragmentary vertical section showing the vent tube in a lowered position and the siphon valve open;

FIG. 7 is a section taken along line 7—7 of FIG. 2;

DESCRIPTION OF THE ILLUSTRATED EMBODIMENT

Figure 2:
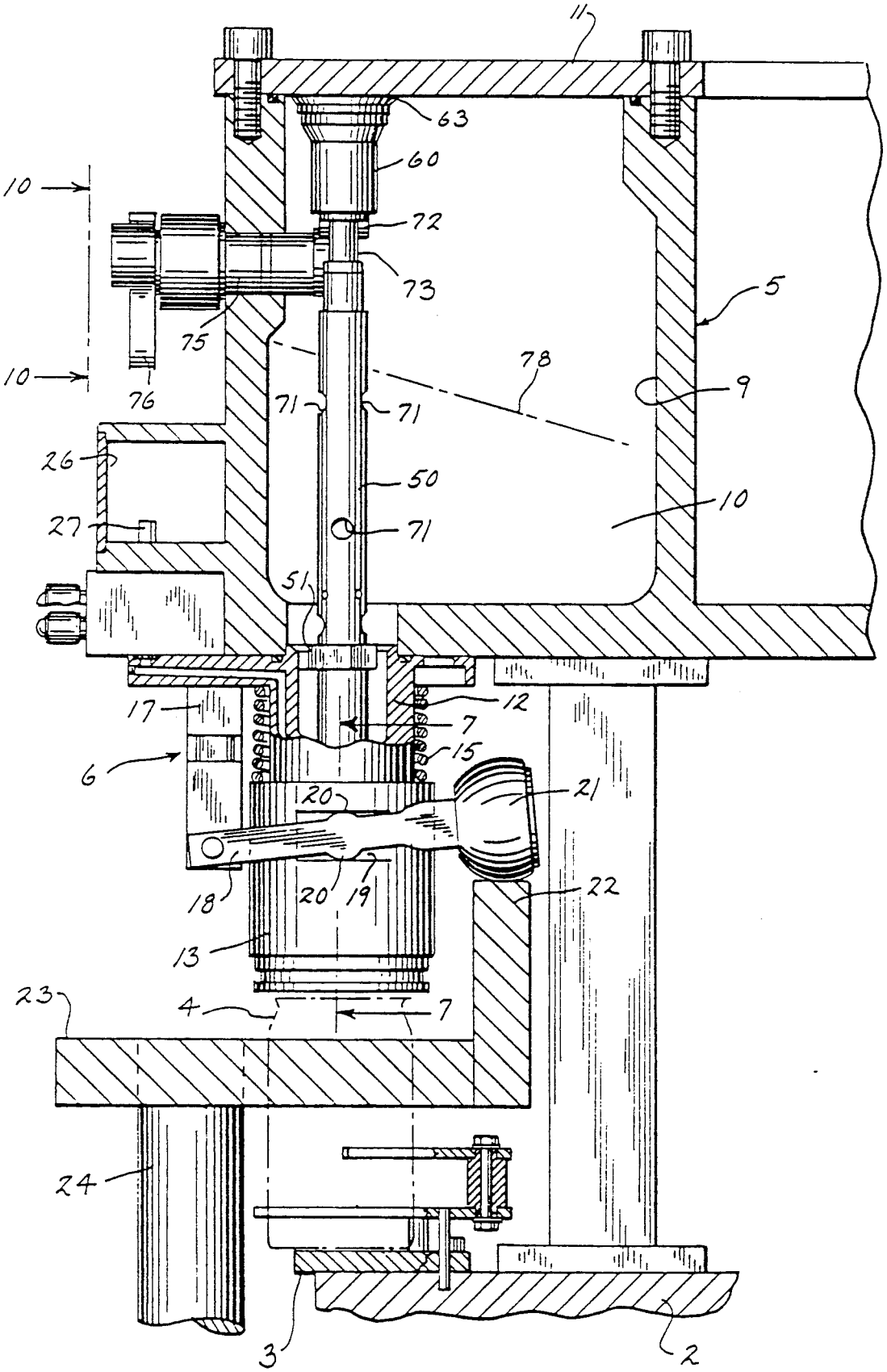
FIG. 2 is a vertical section of a filling head.

FIG. 1 illustrates the can filling machine of the invention which includes a frame or supporting structure 1 and a turntable 2 is mounted for rotation on the frame. A support plate 3, as shown in FIG. 2, is mounted on the turntable and supports a plurality of open topped cans 4 which are adapted to be filled with a liquid or beverage such as beer or a soft drink. A filling bowl 5 is mounted on the turntable above the support plate 3, and a plurality of filling heads 6 are supported from the bowl 5 and each is adapted to dispense a given quantity of liquid from the bowl into the respective can 4.

As shown in FIG. 1, cans 4 are fed to the turntable 2 by an in-feed worm 7 and each can is the transferred by a conventional rotating star wheel conveyor 8 to the turntable.

Bowl 5 defines a closed chamber 9 which contains the liquid product 10 that is to be dispensed into the cans 4. The upper end of the chamber 9 is closed off by a top plate 11.

Each filling head 6 includes a tubular housing 12 which is attached to the undersurface of bowl 5 and a cylindrical tulip 13 is mounted for sliding movement relative to housing 12. A gasket 14 is mounted in a recess in the inner surface of the tulip and serves to seal the interface between tulip 13 and housing 12.

Tulip 13 is biased downwardly into engagement with the upper edge of can 4 by a coil spring 15 that is interposed between the upper end of housing 12 and the upper end of the tulip. The tulip 13 is raised to an elevated or release position by a cam mechanism. In this regard, a vertical bracket 17 is connected to housing 12 and a pair of generally horizontal spaced arms 18 are pivotally connected to the lower end of bracket 17. As best shown in FIGS. 2 and 7, the intermediate portions of arms 18 extend within recesses 19 formed in opposite sides of tulip 13 and the upper and lower surfaces of each arm are provided with projections or domes 20 which engage the respective upper and lower edges of the recess 19.

A roller 21 is carried by the outer ends of arms 18 and the roller is adapted to ride on the upper end of a cam plate 22 which extends upwardly from plate 23. Plate 23 in turn is supported from the frame of the machine by supports 24.

As the turntable 2 rotates and each filling head 8 approaches the starwheel conveyor 8, roller 21 will ride upwardly on the cam 22 to elevate the corresponding tulip 13 against the force of spring 15 to permit the can 4 to be introduced beneath the filling head. After the can 4 is positioned beneath the filling head 8, further rotation of the turntable 2 will cause the roller 21 to ride downwardly on the cam surface 22 and permit the seal 25 on the lower end of the tulip to engage the upper end of the can 4 under the influence of spring 15.

Figure 4:
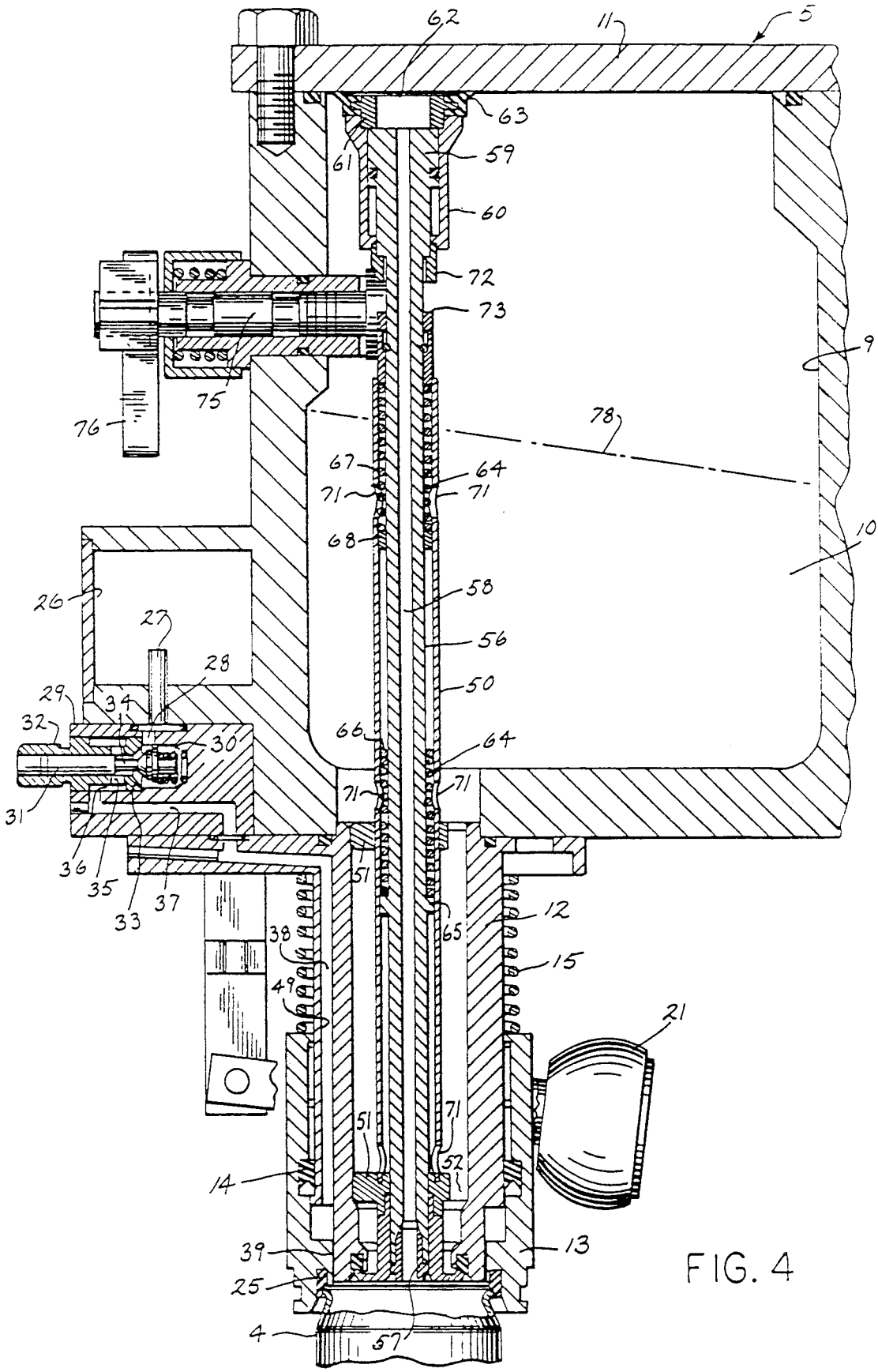
FIG. 4 is a view similar to FIG. 3 showing the tulip sealed against the can and the vent tube in the upper position.

Once the tulip 13 is sealed against the can 4, the can is purged with pure carbon dioxide which is contained within a separate reservior 26 in the filler bowl 5. A tube 27 provides communication between the reservoir 26, and as shown in FIG. 4, a passage 28 in a valve block 29 that is mounted within a recess in the outer portion of the bowl 5. Passage 28 communicates with a horizontal bore 30 and a slide valve 31 is mounted for sliding movement within a sleeve 32 mounted in bore 30. The inner end of sleeve 32 defines a seat 33 to be engaged by valve 31. The outer exposed end of valve 31 is adapted to engage a cam, not shown, as the turntable 2 rotates to thereby open and close valve 31.

As best shown in FIG. 4, slide valve 31 includes a circumferential recess 34 which communicates with holes 35 in sleeve 32, and holes 35 in turn communicate with recess 36 which is connected to passage 37 in the valve block. Passage 37 is connected to a passage 38 formed in the housing 12 and the lower end of passage 38, as best shown in FIG. 6, communicates through the annular gap 39 between tulip 13 and housing 12, with the interior of the can.

During rotation of the turntable 2, valve 31 is moved inwardly to the open position to permit pure carbon dioxide from reservoir 26 to pass through the valve and passages 37, 38, and 39 to the can to purge the can of air.

Figure 3:
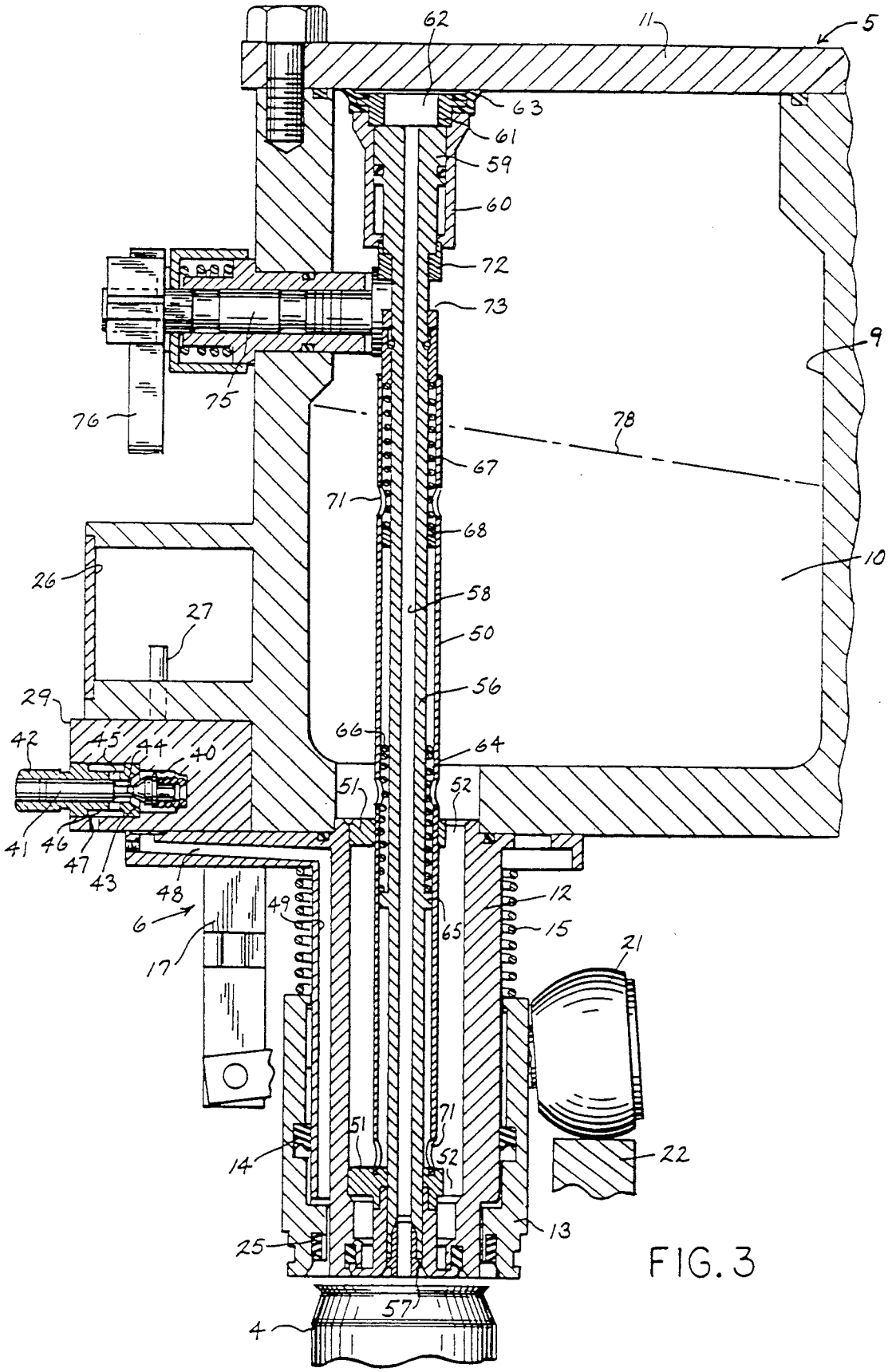
FIG. 3 is an enlarged vertical section of a filling head with the tulip shown in the raised position.

As the can is purged with carbon dioxide the air from the can is vented to the atmosphere through a second valve mechanism also carried by the filling bowl 5. The mechanism, as illustrated in FIG. 3, includes a bore 40 which formed in valve block 29 and a slide valve 41, similar in construction to valve 31, is mounted for sliding movement in a sleeve 42 which is mounted within the bore. The inner end of sleeve 42 defines a valve seat 43 to be engaged by valve 41. The outer end of valve 41 is adapted to be engaged by a cam, not shown, during rotation of the turntable to open and close valve 41.

Valve 41 is provided with a circumferential recess 44 which communicates through holes 45 in sleeve 42 with recess 46 and recess 46 is connected to a vent hole 47.

Connecting passages 48 and 49 are formed in the housing 12. Passage 48 is connected through a hole to the bore 40, while the lower end of passage 49 communicates through gap 39 with the interior of the can. As carbon dioxide is introduced into the can 4, the air is vented through gap 39 passages 49 and 48 and valve 41 to the vent hole 47.

Figure 8:
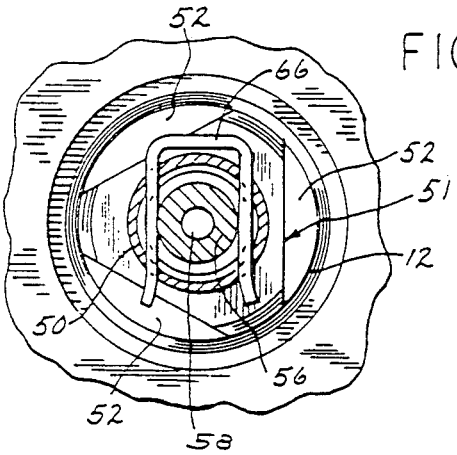
FIG. 8 is a section taken along line 8—8 of FIG. 5.

A fill tube 50 is mounted concentrically within housing 12 and is spaced from the housing by a pair of spacers 51. As best shown in FIG. 8, spacers 51 are formed with a group of arms or projections which engage the inner surface of housing 12, and the gaps between the projections provide passages 52 for the flow of liquid from the bowl 5 into the can 4.

The upper end of fill tube 50 projects through an opening in the lower end of bowl 5 and communicates with the fill chamber 9, while the lower end of the fill tube carries an annular siphon valve 53 having an upturned peripheral edge 54 which is adapted to engage an annular seat 55 mounted within a recess in the lower end of housing 12. Engagement of valve 53 with seat 55 will prevent flow of liquid from bowl 5 to can 4.

Spaced inwardly of fill tube 50 is a vent tube 56 and the lower end of the vent tube carries a tubular insert 57. Vent tube 56 has a longitudinal vent passage 58 and the upper end of the vent tube is provided with an enlarged flange 59 which is mounted for sliding movement within a cylindrical housing 60. The upper end of housing 60 is enclosed by a plug 61 having an axial opening 62, and plug 61 is adapted to seal against top plate 12 by virtue of a resilient annular seal 63 carried by the plug. When the vent tube is in an upper position, seal 63 will engage top plate 11 to close off the upper end of vent passage 58. When housing 60 is lowered, the seal 63 will be released to open the vent passage 58 to the headspace of the bowl chamber 9.

Siphon valve 53 is biased to a closed position by a coil spring 64 which is located in the space between fill tube 50 and vent tube 56. The lower end of spring 64 is engaged with a seat 65 on the vent tube, while the upper end of the spring is engaged with a clip 66 that is mounted in holes in the fill tube 50. See FIG. 8. With this construction, the force of the spring will urge the fill tube 50 upwardly relative to the vent tube 56 to hold the valve 53 in the closed position.

Figure 9:
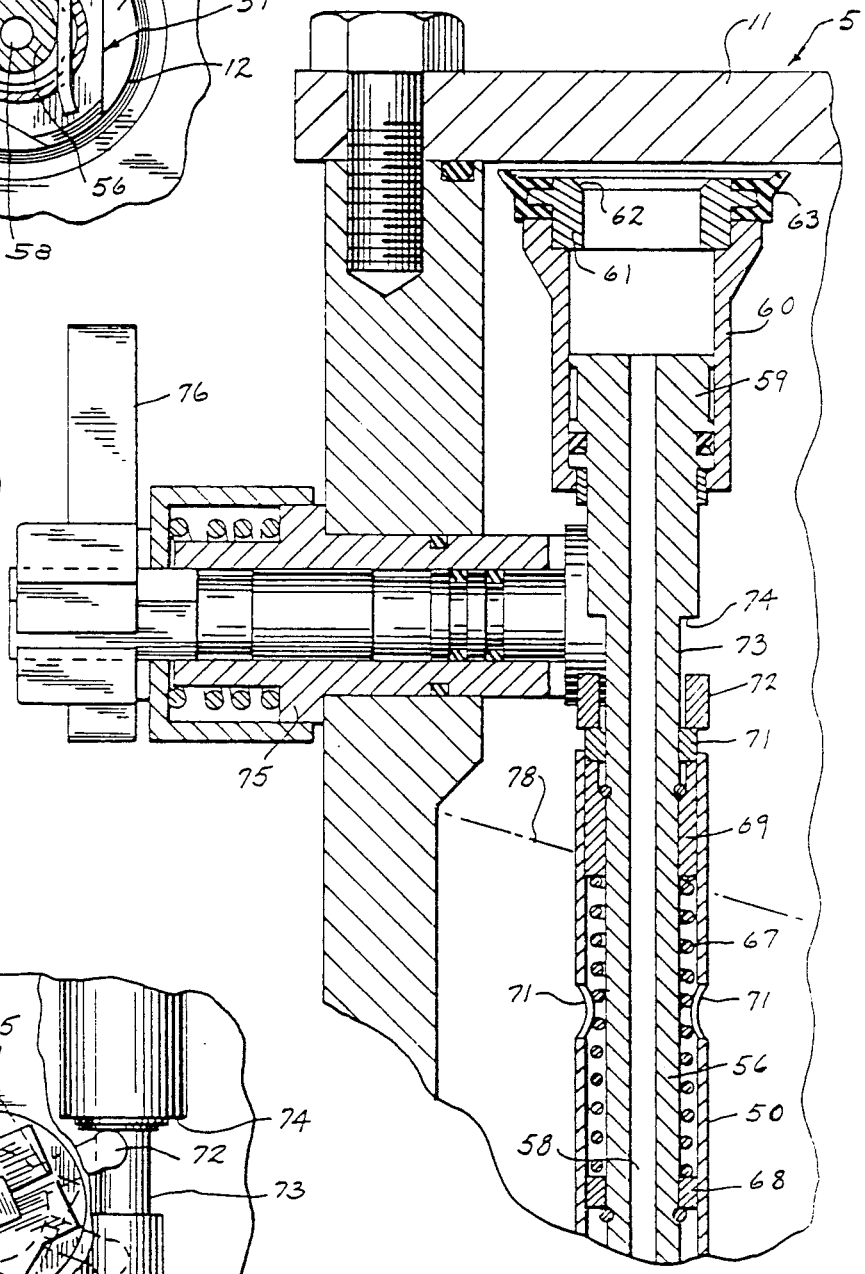
FIG. 9 is an enlarged fragmentary vertical section of the upper end of the filling head.
Figure 10:
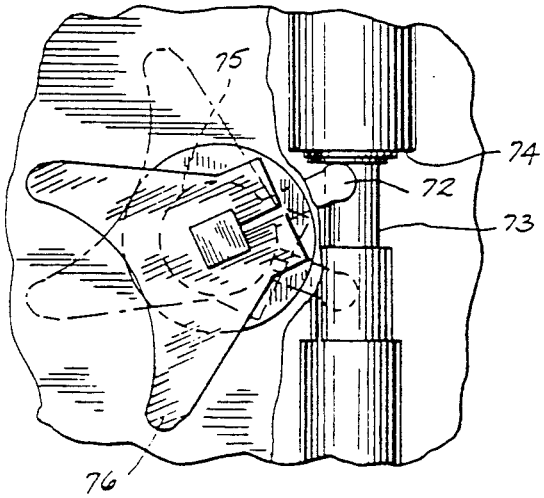
FIG. 10 is a view taken along line 10—10 of FIG. 2 with parts broken away.

A second coil spring 67 is located between the upper ends of the fill tube 50 and vent tube 56. The lower end of the spring 67 is engaged with a seat 68 connected to the vent tube, while the upper end of the spring bears against a sleeve 69 attached to fill tube 50 and which is slidable relative to the vent tube, as illustrated in FIG. 9. Ring 70 bears against the upper end of sleeve 69. Spring 67 acts to compensate for overtravel of the fork mechanism when the valve 53 is opened, as will be described hereinafter.

Fill tube 50 is provided with a plurality of drain holes 71 which enables any liquid to drain from the fill tube for cleaning purposes.

As a feature of the invention the vent tube 56 is movable independently of the tulip 13, and the vent tube is raised and lowered during the filling cycle, by a fork 72 which is mounted within a recess 73 in the upper end of fill tube 50. Recess 73 is defined at its upper extremity by a ledge 74, while the upper edge of ring 70 defines the lower edge of the recess. Fork 72 is mounted on a shaft 75 and the outer end of the shaft carries a butterfly trip 76 which is operated by a cam, not shown, during the rotation of the turntable. As the turntable 2 rotates, the trip 76 will engage a cam to raise and lower the fork 72 and correspondingly operate the fill valve 50 as will be described.

OPERATION

As each filling head 6 approaches the star wheel conveyor 8 during rotation of the turntable 2, the roller 21 will ride up on the cam surface 22 causing the tulip 13 to be elevated to a position where a can 4 can be introduced onto support plate 3 beneath the filling head. After the can is properly positioned on the surface 3, continued rotation of the turntable will cause the roller 21 to ride down on the cam surface 22 to enable the seal 25 at the lower end of the tulip 13 to engage and seal against the upper edge of the can 4.

Figure 5:
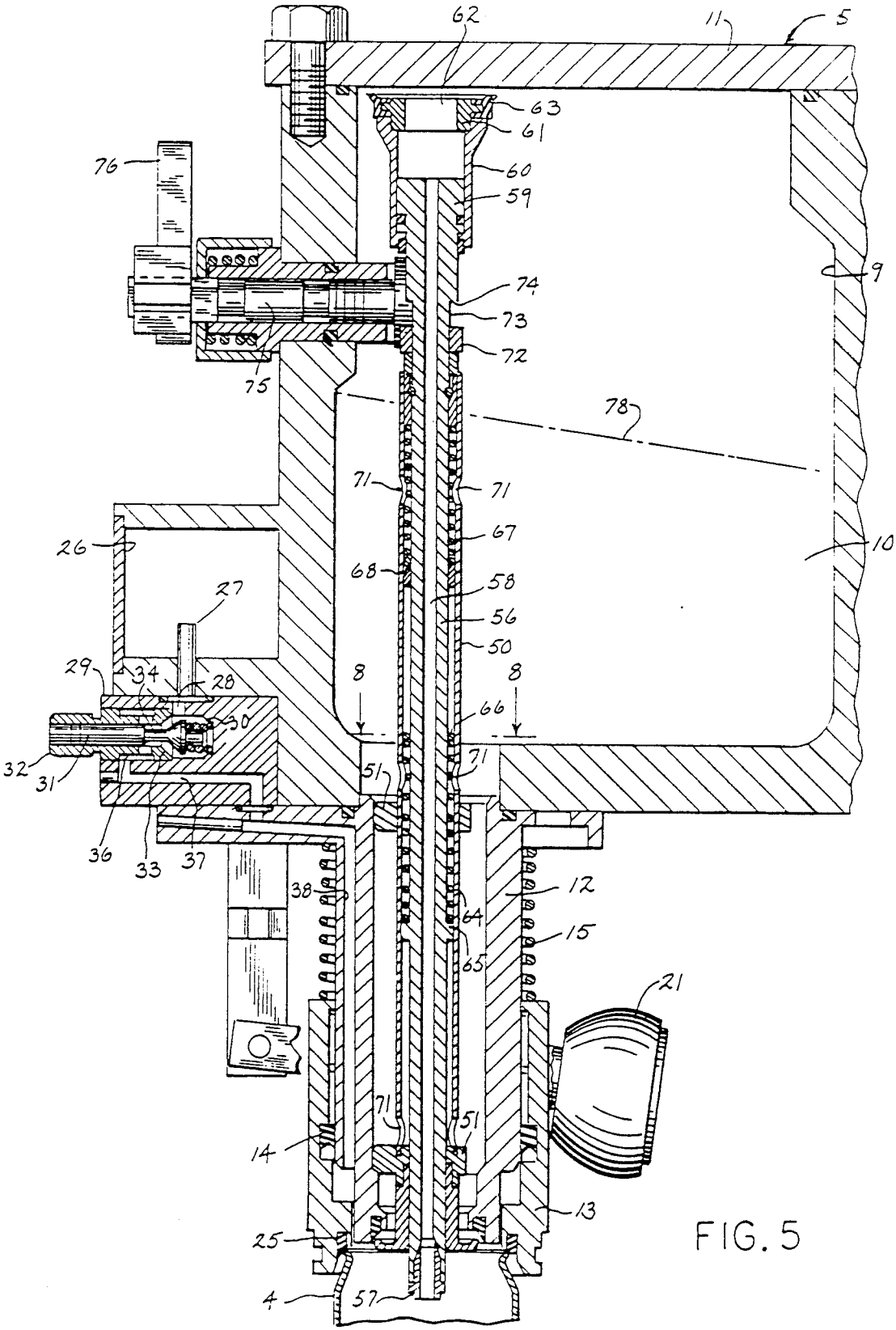
FIG. 5 is a view similar to FIG. 4 with the vent tube being shown in the lower position and the siphon valve being open to admit liquid to the can.

As the turntable 2 continues to rotate, the exposed outer end of valve 31 is engaged by a cam to open valve 31 and admit pure carbon dioxide from reservoir 26 to the can, as shown in FIG. 5. Simultaneously, valve 41 is opened through cam action to permit the air from the can to be discharged through the passages 49 and 48 and vent hole 47 to the atmosphere.

With the can 4 purged of air and pressurized, the interior of the can, as well as the vent passage 58 and the interior of housing 60, will be at the same pressure. As the exposed surface area of the upper end of vent tube 56, within housing 60, is greater than the surface area of the lower end of the vent tube in the can, a greater force is applied against the upper end of the vent tube than against the lower end, causing the vent tube to lower relative to the fill tube 50 to position the lower end 57 within the can, as shown in FIG. 5. Engagement of the lower end of flange 59 on vent tube 56 with the lower end of the housing 60 will determine the lower position of the vent tube.

Continued rotation of the turntable will cause the trip 76 to engage a cam surface to move the fork 72 downwardly against ring 70 to lower the fill tube 50 and open the siphon valve 53. This action also serves to release seal 63 from top plate 12 to provide communication between the interior passage 58 of vent tube 56 with the headspace of the chamber 9.

Downward movement of fill tube 50 and valve 53 is limited by the engagement of the lower spacer 51 with internal shoulder 77 on housing 12, as illustrated in FIG. 6, and spring 67 will compensate for any overtravel of fork 72 in lowering the fill tube.

With the valve 53 open, liquid will then flow from the chamber 9 through the open valve into the can 4 to fill the can, and the gas from the can will be vented through the vent tube 56 and open valve 63 to the headspace of chamber 9.

When the liquid in the can 4 rises to a level to close off the lower end 57 of vent tube 56, the liquid will rise in the vent tube to a level approximating that of the level of liquid in the fill chamber 9. The liquid level is shown by 78 and is at an angle to the horizontal due to centrifugal force produced by rotation of the turntable. To discharge the liquid from the vent tube, the fork 72 is moved upwardly by cam action as the turntable 2 rotates, and spring 64 will close valve 53 to prevent overfill. This action also causes the seal 63 to engage the top plate 11 so that the vent tube passage 58 is then isolated from the fill chamber 9.

Continued upward movement of fork 72 will lift the vent tube flange 59 relative to housing 60 to compress the gas in the housing. The compressed gas will then force the liquid downwardly out of the vent tube passage 58 and back into the can 4.

Further rotation of the turntable 2 will open the valve 41 by cam action to release the gas from the headspace of the can 4 through passage 49 and 48 and vent hole 47.

With the invention the vent tube 56 is operated independently of the tulip 13 and the force differential acting against opposite ends of the vent tube automatically operates to lower the vent tube in the can. Moreover, the liquid is automatically vented from the vent tube 56 by the gas compressed within the upper end of the vent tube and within cylindrical housing 60 as the vent tube is elevated.

The siphon valve 53 provides a uniform laminar flow around the entire circumference of the can to minimize foaming as the liquid is introduced into the can. As the valve 53 is located immediately adjacent the can "after run" is minimized.

In addition the valve 53 is held in the closed position by the internal pressure of the system to prevent leakage.

As a further advantage, the system is pressurized with pure carbon dioxide as opposed to conventional systems using carbon dioxide from the head space of the filler bowl. This reduces any possibility of contamination of the liquid product with oxygen.

In the filling machine of the invention, the rollers 21 and cam 22 are located at the rear of the heads 6, toward the axis of turntable 2, in a position where they will not interfere with maintenance of the filling heads.

The tulip 13 is biased to its closed position by a coil spring 15 which surrounds the housing 12 and provides uniform sealing pressure against the upper end of the can.

As the vent tube 56 can move independently of the tulip the reciprocating stroke of travel of the tulip is reduced, thereby reducing the overall time cycle.

With the invention, the fill height of liquid in the can be changed by varying the liquid level in the fill chamber 9.

Various modes of carrying out the invention are contemplated as being within the scope of the following claims particularly pointing out and distinctly claiming the subject matter which is regarded as the invention.

We claim:

1. In an apparatus for filling open top cans with a liquid, a supporting surface to support a can, a filling head including a first reservoir to contain a liquid and spaced above said supporting surface and having a headspace disposed in said first reservoir above the level of the liquid, a second reservoir separate from said first reservoir and containing carbon dioxide gas, means interconnecting said second reservoir and said can for purging said can with carbon dioxide, means for venting air from said can to the atmosphere when said can is being purged, means for introducing liquid from said first reservoir to said can after said can is purged with carbon doxide, and means for venting carbon dioxide from the can to said headspace as the can is being filled with liquid.

2. The apparatus of claim 1, wherein said means for introducing liquid to said can comprises a conduit extending downwardly from the first reservoir and communicating with the open top can, and valve means for controlling the flow of liquid in said conduit, and said means for venting said carbon dioxide from the can comprises a vent tube communicating between the open top of the can and said headspace.

3. In an apparatus for filling open top cans with a liquid, a supporting surface to support a can, a filling head including a reservoir to contain a liquid and spaced above said supporting surface and having a headspace disposed in said reservoir above the level of the liquid, a vessel separate from said reservoir and containing carbon dioxide gas, first conduit means connecting said vessel with the can, first valve means disposed in said first conduit means and movable between an open position where communication is established between said vessel and said can and a closed position, second conduit means connecting the can with the atmosphere, second valve means disposed in said second conduit means and movable between an open position where said can is connected to the atmosphere and a closed position, means for simultaneously opening said first and second valve means whereby carbon dioxide is delivered through said first conduit means to said can and air contained within the can is discharged through said second conduit means to the atmosphere, fill tube means connected to said reservoir for conducting liquid from said reservoir to said can, and third valve means disposed in said fill tube means and movable between an open position to permit liquid to flow from said reservoir to said can and a closed position.

4. The apparatus of claim 3, and including vent tube means communicating between the can and the headspace of said reservoir, and fourth valve means disposed in said vent tube means and movable between an open position where said vent tube means is in communication with said headspace and a closed position, and means for opening said fourth valve means when said third valve means is open, whereby carbon dioxide contained within said can will be vented through said vent tube means as said liquid fills said can.

5. The apparatus of claim 2, wherein said vent tube is movable independently of said conduit.

* * * * *